US006685614B1

(12) United States Patent
Arnell

(10) Patent No.: US 6,685,614 B1
(45) Date of Patent: Feb. 3, 2004

(54) METHOD OF MANUFACTURING TRAPEZOID-SHAPED PLASTIC ZIPPER BAGS

(76) Inventor: Patrick D Arnell, Box 5214, High River (CA), T1V 1M4

( * ) Notice: Subject to any disclaimer, the term of this patent is extended or adjusted under 35 U.S.C. 154(b) by 116 days.

(21) Appl. No.: 09/564,326

(22) Filed: May 3, 2000

(51) Int. Cl.[7] ..... B31B 1/84

(52) U.S. Cl. ..... 493/213; 493/214; 493/325; 493/394; 493/927

(58) Field of Search ..... 493/213, 214, 493/255, 308, 294, 325, 394, 927

(56) References Cited

U.S. PATENT DOCUMENTS

| | | | | |
|---|---|---|---|---|
| 3,172,796 A | | 3/1965 | Gulker | |
| 4,212,337 A | * | 7/1980 | Kamp | |
| 4,630,312 A | | 12/1986 | Milstein | |
| 4,658,433 A | | 4/1987 | Savicki | |
| 4,778,282 A | | 10/1988 | Borchardt et al. | |
| 4,971,454 A | * | 11/1990 | Branson et al. | 493/927 |
| 5,496,252 A | * | 3/1996 | Gilbert | |
| 5,968,310 A | * | 10/1999 | Clark | 493/927 |
| 6,068,585 A | * | 5/2000 | Ouchi | 493/213 |
| 6,183,590 B1 | * | 2/2001 | Weder | |

FOREIGN PATENT DOCUMENTS

| | | |
|---|---|---|
| DE | 8216718 | 9/1982 |
| EP | 0967155 A | 12/1999 |

* cited by examiner

*Primary Examiner*—Rinaldi I. Rada
*Assistant Examiner*—Sameh Tawfik
(74) *Attorney, Agent, or Firm*—Denton L. Anderson; Sheldon & Mak

(57) ABSTRACT

The invention is a process for manufacturing plastic zipper bags. In the process, zippers are disposed along both opposing edges of a pair of contiguous elongate plastic sheets. The elongate plastic sheets are then divided into individual bags by sealing the two plastic sheets to one another along spaced-apart transverse sealing lines. By these steps, the pair of elongate plastic sheets are transformed into a strip of plastic bags comprising a plurality of individual plastic bags attached to one another along abutting transverse sealing lines. Each plastic bag along the strip of plastic bags has a zippered upper edge and a zippered lower edge. Next, the upper edge of every other plastic bag along the plastic bag strip is sealed with a sealing edge disposed parallel to and proximate to the zipper along the upper edge. On each of the other bags along the plastic bag strip, the lower edge is sealed with a sealing line disposed parallel to and proximate to the zipper along the lower edge. Lastly, the plastic bags are separated from one another by severing the plastic bag strip along the transverse sealing lines.

13 Claims, 1 Drawing Sheet

METHOD OF MANUFACTURING TRAPEZOID-SHAPED PLASTIC ZIPPER BAGS

FIELD OF THE INVENTION

Figure 1:
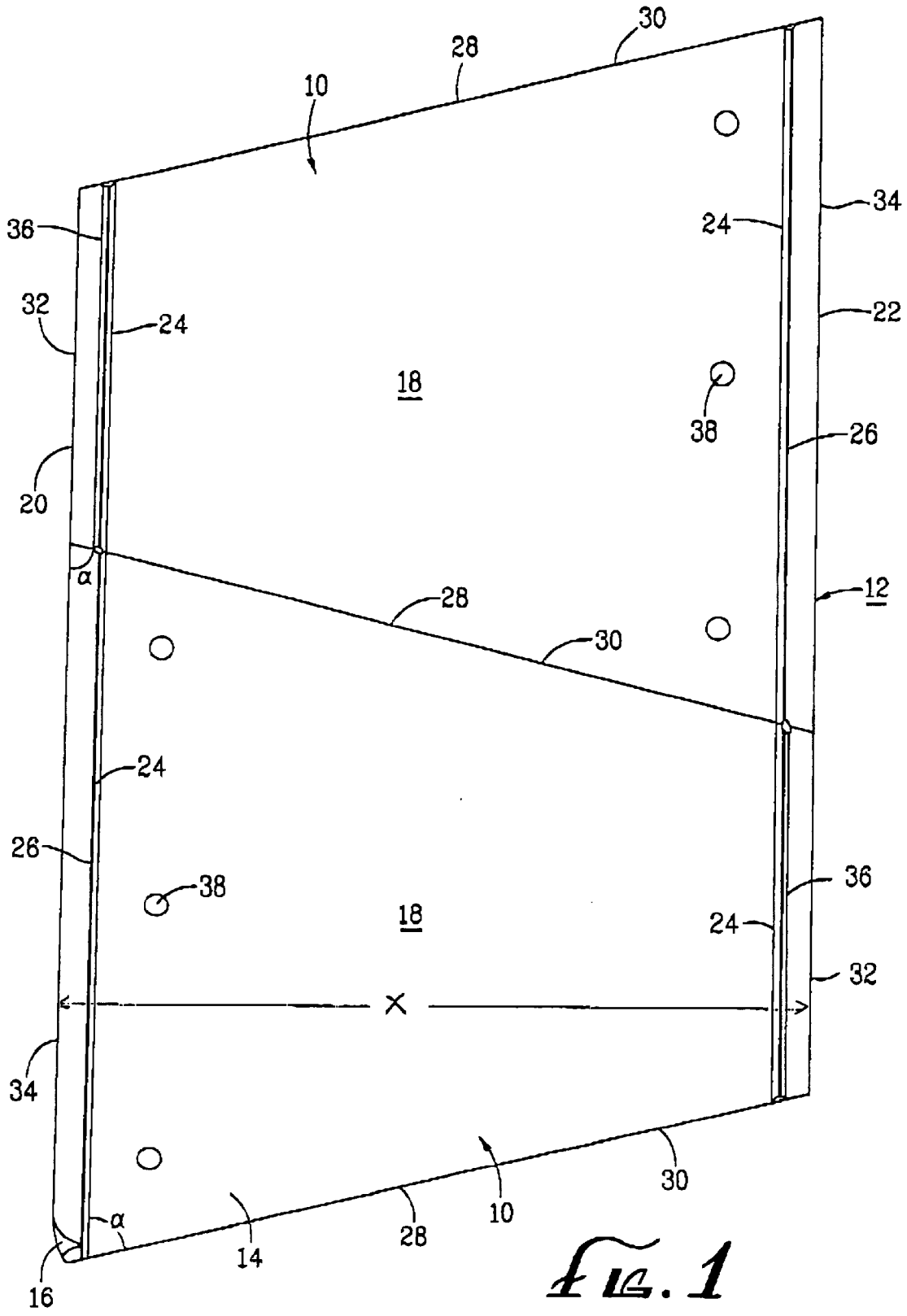

This invention relates generally to plastic bags and, more specifically, to plastic bags having zipper openings.

BACKGROUND OF THE INVENTION

Plastic bags having plastic "zipper" openings have had enormous popularity over the last 20 years. Such plastic bags can be repeatedly sealed and resealed without the necessity of tools and without extraneous devices (such as twist ties, tape, etc.).

Rectangular-shaped plastic zipper bags are by far the most common. However, non-rectangular plastic zipper bags are also frequently used. For example, trapezoid-shaped plastic bags are considered desirable for a myriad of uses, including as storage bags in the sale of certain produce, such as grapes. In such trapezoid-shaped plastic bags, the zipper is generally disposed along the long edge of the bag.

The production line manufacture of rectangular-shaped plastic bags is simple and efficient. A zipper element is disposed along one edge of two elongate plastic sheets, the sheets are sealed on the remaining three sides and then separated from one another along the side edge seals. Because the bags are rectangular, the entirety of the two plastic sheets is readily "dividable" into individual bags, so this method results in no waste material.

The method, however, cannot be efficiently used in the manufacture of nonrectangular bags, such as trapezoid-shaped bags. This is because, with trapezoid-shaped plastic bags, the side of the bags carrying the zipper cannot be aligned along the single edge of an abutting pair of elongate plastic sheets without creating a large amount of waste material between the sealed short sides.

Accordingly, there is a need for a method of manufacturing non-rectangular bags, especially trapezoid-shaped bags, which avoids the above-referenced problems in the prior art.

SUMMARY

The invention satisfies this need. The invention is a new process for manufacturing plastic bags. In the process, zippers are disposed along both opposing edges of a pair of contiguous elongate plastic sheets. The elongate plastic sheets are then divided into individual bags by sealing the two plastic sheets to one another along spaced-apart transverse sealing lines. By these steps, the pair of elongate plastic sheets are transformed into a strip of plastic bags comprising a plurality of individual plastic bags attached to one another along abutting transverse sealing lines. Each plastic bag along the strip of plastic bags has a zippered upper edge and a zippered lower edge. Next, the upper edge of every other plastic bag along the plastic bag strip is sealed with a sealing edge disposed parallel to and proximate to the zipper along the upper edge. On each of the other bags along the plastic bag strip, the lower edge is sealed with a sealing line disposed parallel to and proximate to the zipper along the lower edge. Lastly, the plastic bags are separated from one another by severing the plastic bag strip along the transverse sealing lines.

The method is especially useful in the preparation of trapezoid-shaped bags. However, the method can be easily adapted to make bags having the shape of any nonrectangular tetrahedron.

DRAWINGS

These features, aspects and advantages of the present invention will become better understood with regard to the following description, appended claims and accompanying figures where:

FIG. 1 is an isometric view of a plastic bag strip illustrating features of the invention.

DETAILED DESCRIPTION

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a process for making zipper closeable plastic bags 10. The process is described below with reference to the plastic bag strip 12 illustrated in FIG. 1.

In the process of the invention, a first elongate plastic sheet 14 and a second elongate plastic sheet 16 are first provided. The first and second elongate plastic sheets 14 and 16 will be used to make the side walls 18 of the zipper closeable plastic bags 10 made in the process of the invention. Both the first and second elongate plastic sheets 14 and 16 are typically of uniform thickness, typically between about 0.0014 and about 0.002 in thickness. It is also typical that the first and second elongate plastic sheets 14 and 16 be transparent, or at least translucent. Both the first and second elongate plastic sheets 14 and 16 have a first edge 20 and an opposed parallel second edge 22. The width of both the first and second elongate plastic sheets 14 and 16 have the same width x.

Both the first edge 20 and the second edge 22 of both the first and second elongate plastic sheets 14 and 16 have a plastic zipper strip component 24. Each zipper strip component 24 is disposed parallel to and proximate to the outermost portion of a first edge 20 or a second edge 22. The plastic zipper strip component 24 on the first edge 20 of the first elongate plastic sheet 14 is chosen so as to be mateable with the plastic zipper strip component 24 on the first edge 20 of the second elongate plastic sheet 16. Similarly, the plastic zipper strip component 24 on the second edge 22 of the first elongate plastic sheet 14 is chosen so as to be mateable with the plastic zipper strip component 24 on the second edge 22 of the second elongate plastic sheet 16.

Mateable plastic zipper strip components 24 are well-known in the art, such as the plastic zipper strip components described in U.S. Pat. Nos. 4,212,337, 4,658,433 and 4,778,282, the entireties of which are incorporated herein by this reference.

The first plastic sheet 14 is aligned in abutment with the second plastic sheet 16 such that the zipper component 24 along the first edges 20 of the first and second elongate plastic sheets 14 and 16 are aligned to form a functioning zipper 26 along the first side edge 20, and such that the zipper components disposed along the second side edges 22 of the first and second elongate plastic sheets 14 and 16 are aligned to form a functioning zipper 26 along the second side edges 22.

Once the first plastic sheet 14 is aligned in abutment with the second plastic sheet 16, the first plastic sheet 14 is sealed to the second plastic sheet 16 along a plurality of spaced-apart transverse sealing lines 28. This is conveniently accomplished by use of heat sealing equipment commonly known in the art.

The transverse sealing lines 28 define a plurality of plastic bags 10 disposed side-by-side along a plastic bag strip 14. In the embodiment illustrated in FIG. 1, the plastic bag strip 12 comprises two plastic bags 10.

Each plastic bag 10 along the plastic bag strip 12 has a pair of opposed side edges 30, an upper edge 34 and a lower edge 32. Those side edges 30 of each plastic bag 10 which abut a side edge 30 of an adjoining plastic bag 10 are attached to the side edge 30 of the adjoining plastic bag 10 along a transverse sealing line 28. Each plastic bag 10 along the plastic bag strip 12 has a functioning zipper 26 along its upper edge 34 and along its lower edge 32.

The transverse sealing lines 28 are disposed at equal acute angles $\alpha$ with respect to the side edges 30 of the two elongate plastic sheets 14 and 16. In a typical embodiment, such acute angles a are between 70° and about 80°. Because the angles $\alpha$ are acute angles, the resulting plastic bags 10 are shaped as non-rectangular, regular tetrahedrons. Where each transverse sealing line 28 is disposed at the same acute angle $\alpha$ with respect to the side edges 30 of the two elongate plastic sheets 14 and 16, the resulting plastic bags 10 along the plastic bag strip 12 are parallelogram-shaped. In the embodiment illustrated in FIG. 1, alternating transverse sealing lines 28 are disposed at equal acute angles a and the remaining transverse sealing lines 28 are disposed at equal angles of $-\alpha$. As can be seen in FIG. 1, this design yields plastic bags 10 along the plastic bag strip 12 which are trapezoid-shaped.

Next in the process of the invention, the lower edge 32 of each plastic bag 10 along the plastic bag strip 12 is sealed by sealing the first plastic sheet 14 to the second plastic sheet 16 along a longitudinal sealing line 36 disposed parallel to and proximate to the lower edge 32 of each plastic bag 10 along the plastic bag strip 12.

Finally, the plastic bags 10 along the plastic bag strip 12 are separated from one another by cutting the plastic bag strip 12 along the transverse sealing lines 28. The resulting plastic bags 10 have a pair of opposed side walls 18, three sealed edges 30 and 32 and one opening upper edge 34. In a typical trapezoid-shaped grape bag, the lower edge is between 5 inches and 7¾ inches, and the opening upper edge is between 11 inches and 13 inches. The exterior depth of each plastic bag 10 is x. In a typical embodiment, x is between 9 inches and 13 inches. The opening upper edge 34 is sealable by a functioning plastic zipper 26.

In the most typical embodiment, the functioning plastic zipper 26 is a reversible zipper, meaning that it is reversibly sealable and unsealable. The functioning plastic zipper 26 can, on the other hand, be a sealing zipper, meaning that it is sealable but not sealable. Such a sealable zipper is disclosed in U.S. Pat. No. 5,851,071, the entirety of which is fully incorporated herein by this reference.

The side walls 18 of each plastic bag 10 can be unperforated or they can be perforated with one or more perforations 38, as illustrated in FIG. 1.

The invention provides a simple and highly efficient method of manufacturing non-parallel plastic zipper bags. Because of the unique steps of the inventive method, non-rectangular plastic zipper bags can be manufactured simply, efficiently and without significant wasted material.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A process for making a non-rectangular zipper closeable plastic bags of depth x comprising the steps of:

(a) providing a first elongate plastic sheet of width x, the first plastic sheet having a first edge and an opposed parallel second edge, both the first edge and the second edge of the first elongate plastic sheet having a plastic zipper strip component;

(b) providing a second elongate plastic sheet of width x, the second plastic sheet having a first edge and an opposed parallel second edge, both the first edge and the second edge of the second elongate plastic sheet having a plastic zipper strip component;

(c) aligning the first plastic sheet in abutment with the second plastic sheet, such that the respective zipper components along the edges of both plastic sheets are aligned to form a pair of opposed zipperable side edges;

(d) sealing the first plastic sheet to the second plastic sheet along a plurality of spaced apart transverse sealing lines disposed at non-right angles with respect to the side edges of the first and second plastic sheets to thereby form a plastic bag strip comprising a plurality of plastic bags, each having a pair of opposed side edges, an upper edge and a lower edge, side edges of each plastic bag which abut a side edge of an adjoining plastic bag being attached to the side edge of the adjoining plastic bag along a transverse sealing line, and each upper edge and each lower edge of each plastic bag having a functioning zipper;

(e) sealing the lower edges of each plastic bag along the plastic bag sheet by further sealing the first plastic sheet to the second plastic sheet along a sealing line disposed parallel to and proximate to the zipper on the lower edges of each plastic bag along the plastic bag strip; and (f) separating each plastic bag along the plastic bag strip by cutting the plastic bag strip along the transverse sealing lines so as to yield a plurality of individual plastic bags having a pair of opposed side walls, three sealed edges and one opening edge, which opening edge is sealable by a zipper disposed along the opening edge.

2. The process of claim 1 wherein the number of plastic bags in the plastic bag strip is two.

3. The process of claim 1 wherein the traverse sealing lines are disposed at acute angles to the side edges of the plastic sheets.

4. The process of claim 1 wherein the transverse sealing lines are disposed at an angle of between 70° and 80° with respect to the side edges of the plastic sheets.

5. The process of claim 1 wherein each individual plastic bag has an exterior depth x of between 9 inches and 13 inches.

6. The process of claim 1 wherein each individual plastic bag has the shape of a non-rectangular, regular tetrahedron.

7. The process of claim 1 wherein each individual plastic bag is trapezoid in shape.

8. The process of claim 1 wherein the lengths of the upper edge is between 11 inches and about 13 inches.

9. The process of claim 1 wherein the length of the lower edge is between 5 inches and 7¾ inches.

10. The process of claim 1 wherein the zipper along the opening edge of each plastic bag is reversibly sealable and unsealable.

11. The process of claim 1 wherein the zipper along the opening edge of each plastic bag is sealable but not unsealable.

12. The process of claim 1 wherein the side walls of the individual bags are perforated.

13. The process of claim 1 wherein the side walls of the individual plastic bags are unperforated.

* * * * *